US010745874B2

(12) United States Patent
Larue

(10) Patent No.: US 10,745,874 B2
(45) Date of Patent: Aug. 18, 2020

(54) SNOW REMOVAL ASSEMBLY

(71) Applicant: J.A. LARUE INC., Québec (CA)

(72) Inventor: Denis Larue, Quebec (CA)

(73) Assignee: J.A. LARUE INC., Quebec (CA)

( * ) Notice: Subject to any disclaimer, the term of this patent is extended or adjusted under 35 U.S.C. 154(b) by 0 days.

(21) Appl. No.: 16/171,787

(22) Filed: Oct. 26, 2018

(65) Prior Publication Data

US 2019/0127934 A1 May 2, 2019

Related U.S. Application Data

(60) Provisional application No. 62/577,267, filed on Oct. 26, 2017.

(51) Int. Cl.
*E01H 5/06* (2006.01)
*E01H 5/09* (2006.01)

(52) U.S. Cl.
CPC ..... *E01H 5/092* (2013.01); *E01H 5/061* (2013.01); *E01H 5/098* (2013.01)

(58) Field of Classification Search
CPC ..... E01H 5/061; E01H 5/062; E01H 5/092; E01H 5/098
USPC ..... 37/219, 221–223, 234–236
See application file for complete search history.

(56) References Cited

U.S. PATENT DOCUMENTS

| | | | | |
|---|---|---|---|---|
| 7,793,376 | B2 | 9/2010 | Rush et al. | |
| 9,303,376 | B2 | 4/2016 | Arntz | |
| 9,493,921 | B2 | 11/2016 | Amin et al. | |
| 2015/0033589 | A1* | 2/2015 | McAdam | E01H 5/06 37/231 |

FOREIGN PATENT DOCUMENTS

| | | | | |
|---|---|---|---|---|
| CA | 2985957 | A1 * | 11/2016 | E01H 5/066 |
| EP | 1788156 | A2 * | 5/2007 | E01C 19/20 |

* cited by examiner

*Primary Examiner* — Tara Mayo-Pinnock
(74) *Attorney, Agent, or Firm* — Norton Rose Fulbright Canada LLP; Alexandre Daoust

(57) ABSTRACT

An assembly for releasable attachment to a vehicle. The assembly comprises a frame including a mounting member configured to be mounted onto the vehicle, a plow blade mounted to the frame and a power broom coupled to the frame and disposed between the mounting member and the plow blade. The power broom is configured to be disposed in front of a most forward wheel of the vehicle relative to a forward direction of travel of the vehicle. The power broom is also configured to rotate to sweep snow away from the power broom.

20 Claims, 8 Drawing Sheets

SNOW REMOVAL ASSEMBLY

TECHNICAL FIELD

The application relates generally to snow removal vehicles, and more particularly to snow removal assemblies.

BACKGROUND

In airports, for instance, it was known to remove snow using a succession of vehicles. A typical sequence of such vehicles includes a snow plow, power broom, air blower and snow blower. The snow plow removes the bulk of the snow, but typically leaves behind a thin layer. One or more subsequent vehicles have the role of removing this thin layer of remaining snow.

SUMMARY

As the snow plow removes the bulk of the snow, its wheel(s), located behind the plow in the direction of movement, can compress the snow of the thin layer which was unremoved by the snow plow, leaving tracks of such compacted snow. These tracks of compacted snow can be more difficult to remove with an air blower or power broom which is carried by a subsequent vehicle in the sequence. This was inconvenient.

In one aspect, there is provided a snow removal assembly that incorporates a plow blade mounted ahead of a power broom relative to a forward direction of travel of the vehicle. The snow removal assembly can be mounted to the front of a single motorized vehicle. Accordingly, even the front wheels of the vehicle are located behind the plow blade and power broom relative to the direction of movement of the vehicle, and the power broom can operate on the thin layer of snow which bypasses the plow blade immediately after the plow blade, which can avoid the formation of compressed tracks between the plow blade and the power broom, and thereby improve the efficiency of the power broom.

In another aspect, there is provided a snow removal vehicle comprising a plow blade mounted ahead of a power broom relative to a forward direction of travel of the vehicle. Wheels of the vehicle are located behind the plow blade and the power broom to avoid compacting the snow between the plow blade and the power broom.

It will be understood that the expression 'computer' as used herein is not to be interpreted in a limiting manner. It is rather used in a broad sense to generally refer to the combination of some form of one or more processing units and some form of memory system accessible by the processing unit(s). Similarly, the expression 'controller' as used herein is not to be interpreted in a limiting manner but rather in a general sense of a device, or of a system having more than one device, performing the function(s) of controlling one or more device such as an electronic device or an actuator for instance.

It will be understood that the various functions of a computer or of a controller can be performed by hardware or by a combination of both hardware and software. For example, hardware can include logic gates included as part of a silicon chip of the processor. Software can be in the form of data such as computer-readable instructions stored in the memory system. With respect to a computer, a controller, a processing unit, or a processor chip, the expression "configured to" relates to the presence of hardware or a combination of hardware and software which is operable to perform the associated functions.

DESCRIPTION OF THE DRAWINGS

Reference is made to the accompanying figures in which.

DETAILED DESCRIPTION

Figure 1:
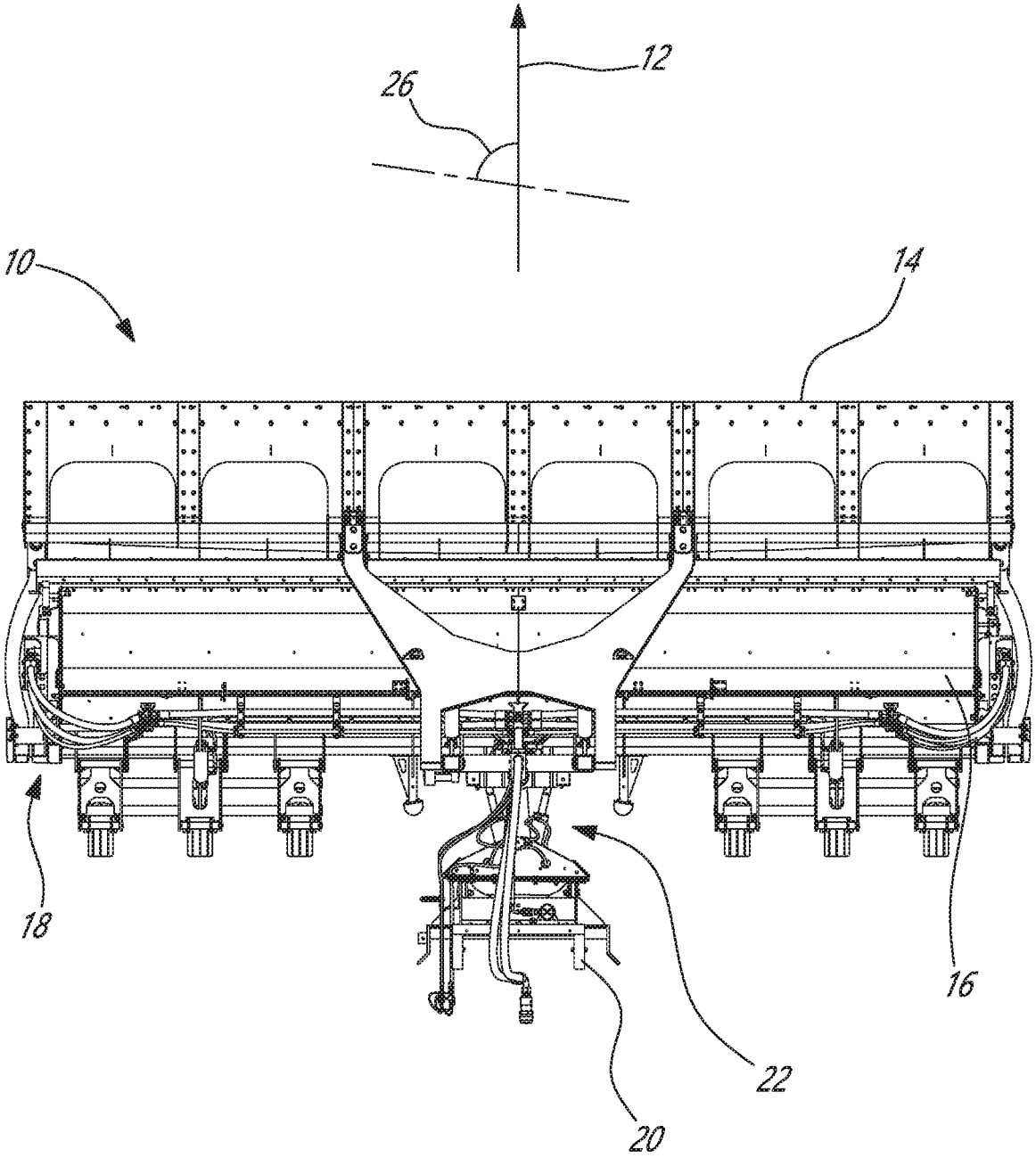
FIG. 1 is a top plan view of a snow removal assembly.

FIG. 1 illustrates an assembly 10 having both a plow blade and a power broom, and which can be releasably attached to a motorized vehicle. The vehicle can be, for example, a truck or a tractor, having an engine and a wheeled chassis. In the embodiment illustrated, the vehicle has a source of hydraulic power which can be connected to power the assembly. The assembly 10 can be used to remove snow from the ground surface. In use, the vehicle can travel in a forward direction 12.

Figure 2:
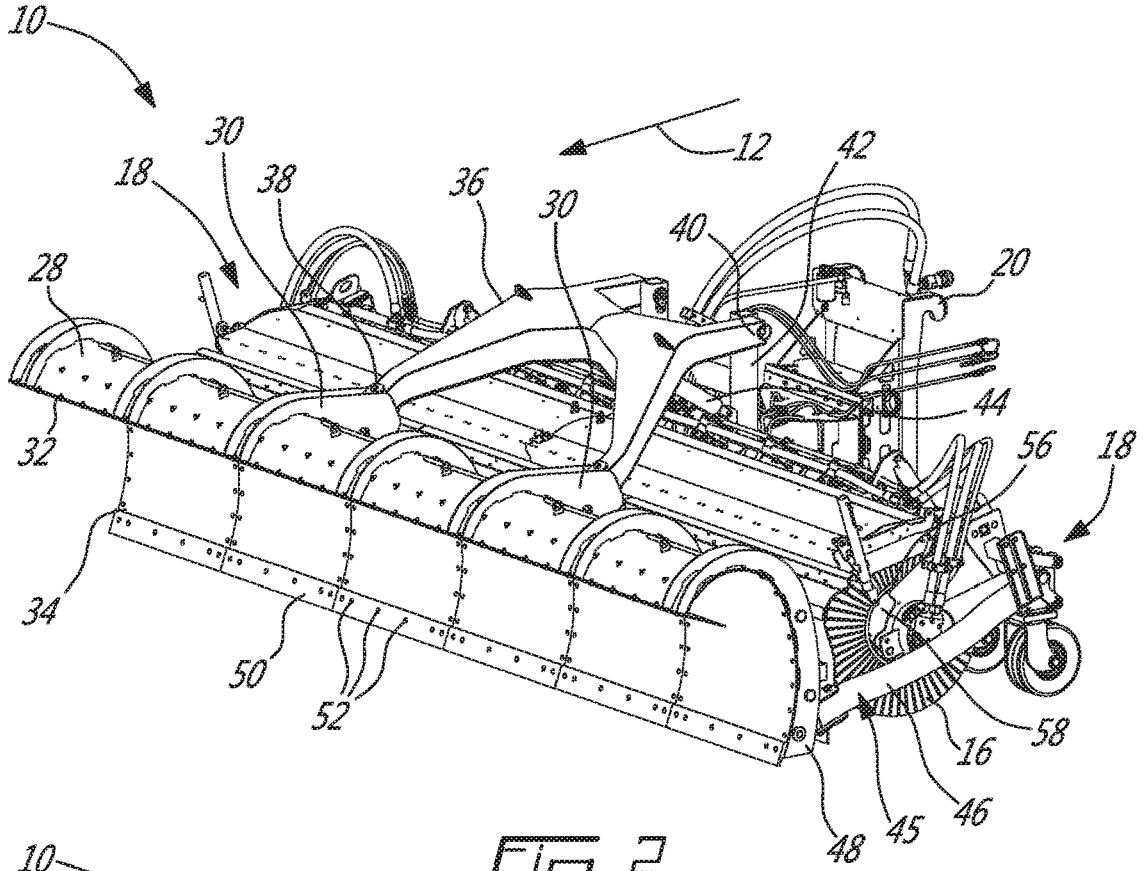
FIG. 2 is a front perspective view of the snow removal assembly shown in FIG. 1.

As better seen in FIG. 2, the assembly 10 comprises a plow blade 14 and a power broom 16. The power broom 16 can be provided in the form of a rotatable broom, generally cylindrical in shape, and powered into rotation during use. The assembly 10 can allow providing the sequence of plow blade 14 and power broom 16 ahead of the wheels of any vehicle, so as to prevent the compression, by the wheels of the vehicle before passage of the power broom, of the fine layer of material which can remain on the ground after the passage of the plow blade 14. In this embodiment, the assembly 10 is provided as an attachment, and is separable from the vehicle. In an alternate embodiment, the assembly 10 can be made integral to the vehicle or a portion of it can be made integral to the vehicle while another portion of it can be provided in the form of an attachment, as will be understood by persons having ordinary skill in the art. Moreover, in this embodiment, the plow blade 14 and power broom 16 are provided with the ability to be independently engaged or disengaged from the ground. Such features are optional, but can nonetheless be advantageous in certain applications, and will be detailed below.

During use, the plow blade 14 removes the bulk of the snow accumulated on the ground surface. Subsequent to the removal of the bulk of the snow with the plow blade 14, the power broom 16 sweeps the thinner layer of snow that may remain on the ground surface after the passage of the plow blade 14. This sequence can be particularly useful in removing snow from airport runways, tarmacs, aprons and taxiways.

The assembly 10 has a frame 18 including a mounting member 20 to attach the frame 18 to the vehicle. In the embodiment shown in FIG. 1, the mounting member 20 is disposed at the rear of the assembly 10 relative to the forward direction of travel 12, and extends rearwardly from the frame 18. The power broom 16 includes a shaft 58 having bristles extending radially therefrom and being rotatably mounted between two side connectors 62, which are non-pivotally secured to the frame 18. A drive motor is coupled to the shaft 58 on each side to rotate the broom 16 at a desired speed and/or power. In alternate embodiments, the driving power train may differ, as will be understood by persons having ordinary skill in the art.

Figure 4:
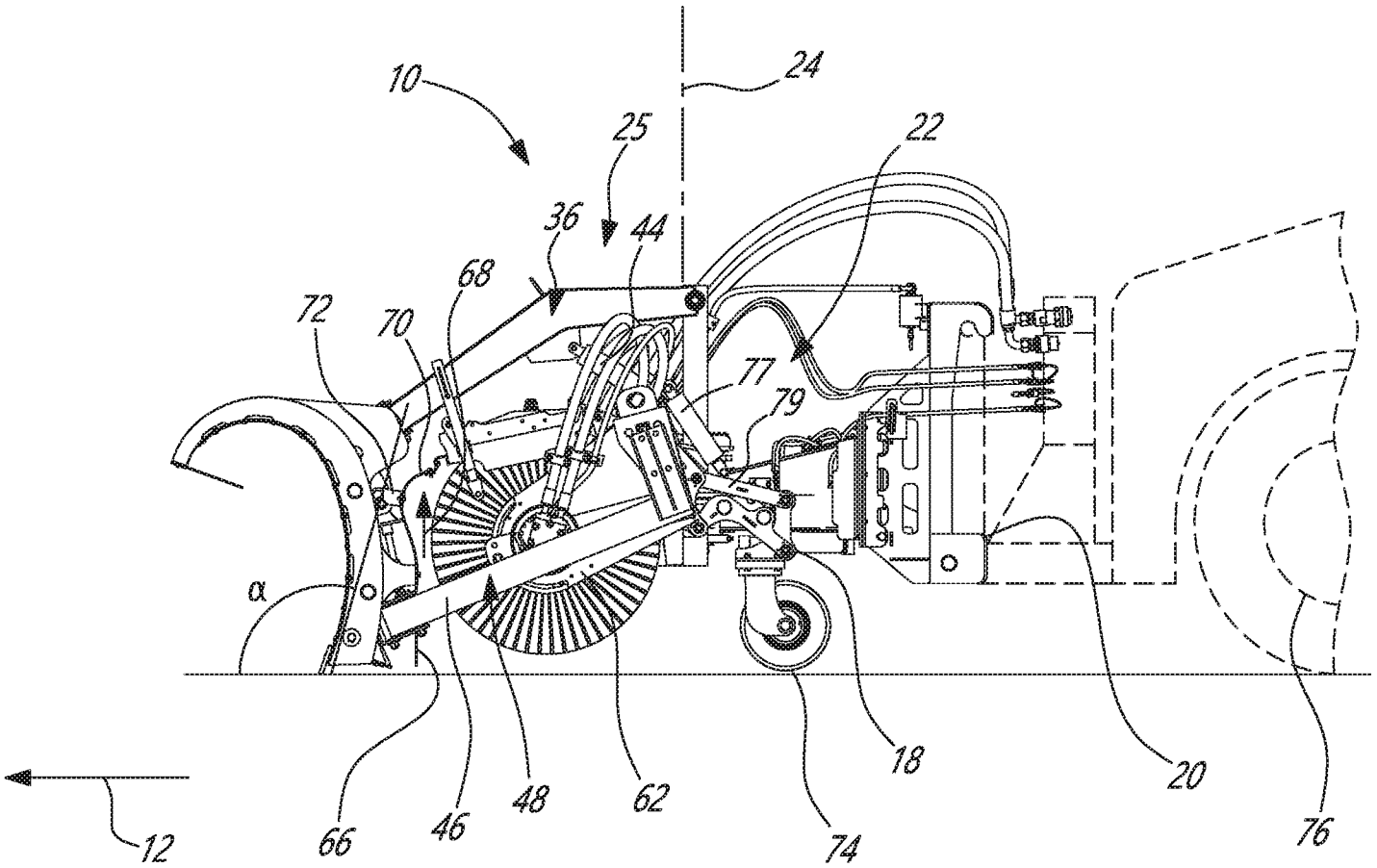
FIG. 4 is a side view of the snow removal assembly shown in FIG. 1 and, in dashed lines, potential placements of wheel(s) of a vehicle relative to the snow removal assembly.

As best seen in FIGS. 1 and 4, a pivotal connection driven by an extendible member assembly 22 can be provided between the frame 18 and the mounting member 20 to pivot the snow removal assembly 10 about a vertical axis 24 (shown in FIG. 4) that is substantially transverse to the forward direction of travel 12, e.g. transverse to the ground surface. This pivoting movement can enable the plow blade 14 and the power broom 16 to be oriented obliquely at an oblique angle 26 with respect to the forward direction of travel 12, such as schematized in FIG. 1. The space between a corresponding longitudinal axis of the plow blade 14 and/or the power broom 16 and the forward direction of travel 12 defines the oblique angle 26. The extendible member can be hydraulic cylinders, for instance, if hydraulic power is used, or other types of members which may be drivably adjustable in length.

Figure 5:
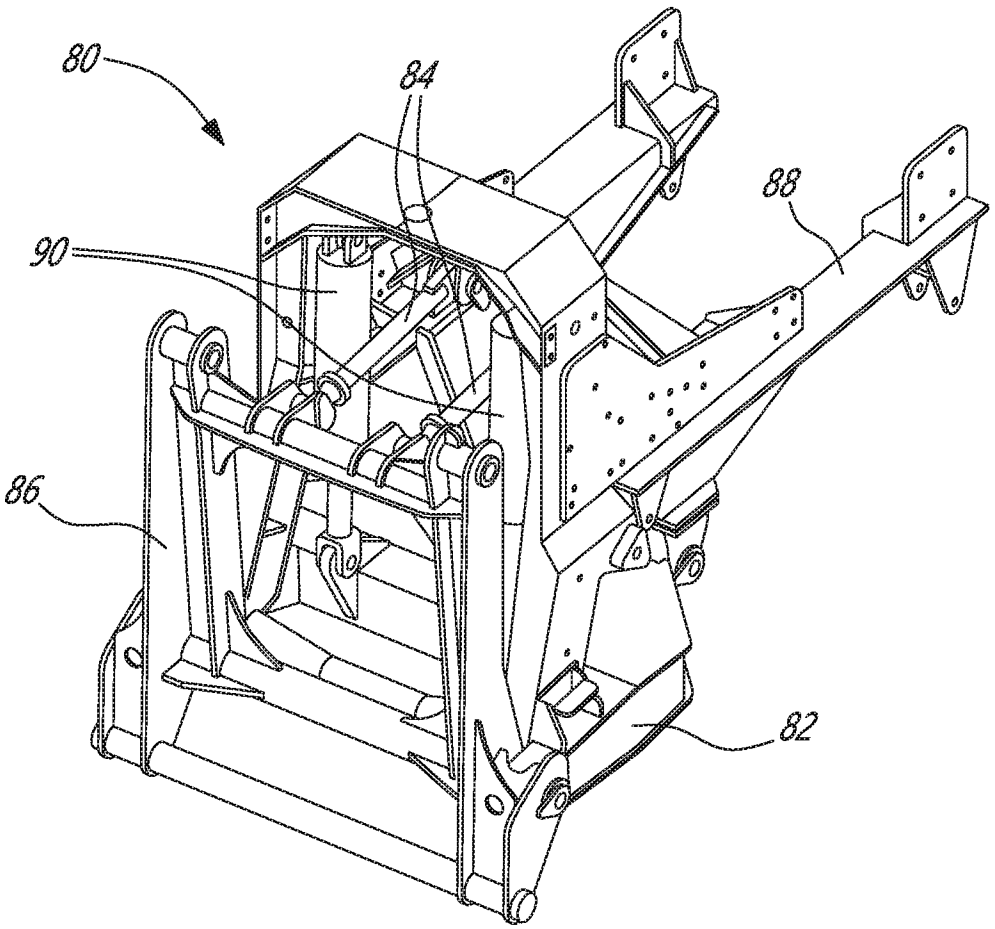
FIG. 5 is an front perspective view of an example of an adjustable-height mount of a vehicle which can receive a snow removal assembly

It will be understood that in this embodiment, the mounting member 20 is configured to be secured to an adjustable-height mount 80 of the vehicle (an example of which is shown in FIG. 5). As known in the art, the adjustable-height mount 80 of the vehicle can have two parallel connector members 82, 84 extending between a frame of the vehicle and a mount portion 86. The two parallel connector members 82, 84 each being pivotally connected at both ends, with a first end being pivotally connected to the mount portion 86 and the second end being pivotally connected to a frame portion 88 which is fixedly securable to the vehicle chassis. The parallel connector members 82, 84 can be pivoted collectively by an actuator such as an extendible member assembly 90 of the vehicle, in a manner to allow raising and lowering the mount portion 86 while maintaining its orientation relative to the ground remains pretty much the same independently of its height. The mount portion 86 is adapted to securely receive the mounting member 20 of the assembly 10. The frame 18 can be raised and lowered by the activation of the extendible member assembly 90. During a mode of operation in which the power broom is activated to sweep snow, the extendible member assembly 90 of the vehicle can be operated in a "floating" mode. In the floating mode, the extendible member assembly 90 does not raise the assembly 10 from the ground. However, the floating mode can be compensated or not. In a non-compensated mode, the extendible member assembly 90 will not exert any significant vertically oriented force on the assembly 10, and essentially the full weight of the assembly 10 will be supported by the ground. In a compensated mode, the extendible member assembly 90 will exert a compensation raising force on the assembly 10. The compensation raising force will not be greater than the weight of the assembly 10, and will thus not be sufficient to raise the assembly 10 from the ground, but can nonetheless have the effect of transferring a portion of the weight of the assembly 10 onto the wheels of the vehicle, which can be useful in certain circumstances, as it can increase the amount of traction of the vehicle's wheels for instance. Compensating for the weight with hydraulic force can be implemented by the use of a sensor, for instance, which provides an indication of the relative height to a computer which controls the application of the hydraulic force on the basis of an input provided by the user in the vehicle. The input can be a height value which can be stored in memory, for instance. In some cases, it can be preferred to make the degree of compensation adjustable.

Referring back to FIG. 3, the frame 18 can be supported on the ground via supporting wheels 74. In this embodiment, the supporting wheels 74 are mounted to a common subframe element, and are thus collectively mounted to the frame 18 via a connector member assembly 79. During a mode of operation in which the power broom is activated to sweep snow, the extendible member assembly 90 of the vehicle can be operated in a "floating" mode such as presented above. In this mode of operation, the frame 18, mounting member 20 and mount portion 86, which can be integral to one another, can be pushed upwardly or downwardly by their weight or by the ground forcing against the wheels 74. The wheels 74, via the connector member assembly 79, can thus maintain the operating height of the frame 18 and associated components by abutment against the ground. The connector assembly 79 of the supporting wheels 74 can be operated by an actuator such as an extendible member 77 to selectively raise or lower the frame 18 (and therefore the power broom 16, the mount 20 and the vehicle's adjustable-height mount) relative to the ground. This mechanism can be actuated to entirely disengage the power broom 16 from the ground, for instance, which can, in this embodiment, be done independently from the selective engagement or disengagement of the plow blade 14 from the ground as will be presented in greater detail below.

FIG. 2 illustrates a back face 28 of the plow blade 14 that is mounted to a front of the frame 18. Several structural ribs 30 extend on the back face 28 between upper and lower edges 32, 34 of the plow blade 14. Equipment such as actuators, electrical wires, fluid tubes and the like can be mounted on the back face 28 of the plow blade 14 between the ribs 30.

Figure 3:
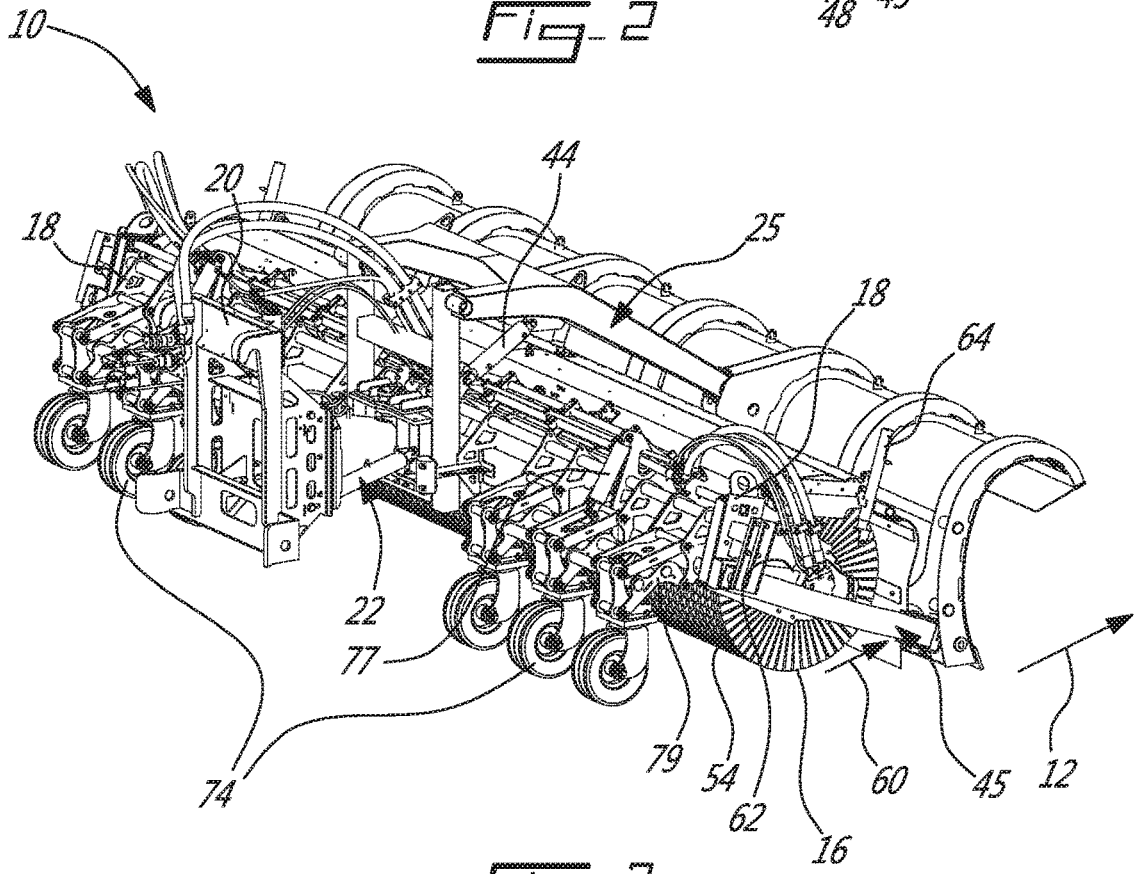
FIG. 3 is a rear perspective view of the snow removal assembly shown in FIG. 1.

As best seen in FIGS. 3 and 4, the plow blade 14 is mounted to the frame via a dual member assembly 25. The dual member assembly generally includes a first connector member 36 linking an upper portion of the plow blade 14 to the frame 18. A first end 38 of the first connector member 36, more specifically at two ends of corresponding arm members, is pivotally mounted (hinged) to corresponding structural ribs 30 of the plow blade 14 and a second end 40 of the first connector member 36, more specifically two ends of corresponding arm members, is pivotally mounted (hinged) to corresponding beams 42 extending upwardly from the frame 18. The details of the connection between the first connector member 36, the plow blade 14 and the frame 18 can vary in alternate embodiments. The end 38 of the first connector member 36 can be selectively raised or lowered, thereby raising or lowering the plow blade, by operating an actuator such as an extendible member assembly 44 which is provided here between the first connector member 36 and the frame 18.

The dual member assembly 25 further has a lower connector member 45 including two side arms 46 in which each side arm 46 links each lateral side 48 of the plow blade 14 to the frame 18. The side arms 46 also have a first end pivotally mounted to a lower portion of the plow blade 14, and a second end pivotally mounted to the frame 18. The The first connector member 36 and the second connector member 45 operate generally parallel to one another when the plow blade is raised or lowered, which maintains the relative orientation between the plow blade and the ground. Indeed, one feature of the upper connector member 36 and the lower connector member 45 is that they both have a fixed length, are pivotally mounted at fixed positions relative to the plow blade 14 and to the frame 18, and are vertically interspaced from each other (i.e. offer a parallel-type connection). When any one of the two connector members 36, 45 is raised or lowered (such as by action of extendible member assembly 44 for instance), the other one of the two connector members 36, 45 follows the movement of the first, thereby maintaining the angle of attack a (FIG. 4) between the plow blade and the ground surface independently of the variations in relative height between the plow blade and the frame 18.

When plowing, the extendible member assembly 44, or more specifically the actuators thereof, can be left "floating" to allow the plow blade to naturally abut against the ground due to the effect of gravity on its weight via the pivoting action of the dual member assembly relative to the frame. This floating mode can also be uncompensated, or compensated, and compensation if used, can be applied independently of any compensation in the extendible member assembly 90, for instance. The extendible member assembly 44 can also be activated to selectively raise the plow blade from the ground, or lower it back down, when desired. It will be noted here that operating the extendible member assembly 44 in floating mode when the plow blade is engaged with the ground is not suitable for all applications. In particular, if the plow blade is very heavy, it can be preferred to compensate for its weight with hydraulic force. Compensating for the weight with hydraulic force can be implemented by the use of a sensor, for instance, which provides an indication of the relative height of the plow blade to a computer which controls the application of the hydraulic force on the basis of an input provided by the user in the vehicle. The input can be an operating height value of the plow blade which can be stored in memory, for instance.

Indeed, the plow blade 14 has an angle of attack a relative to the ground surface. The angle of attack can be set via the relative length and positioning of the connector 36 and the side beams 46. The assembly 10 can thus maintain the angle of attack by coordinately raising and lowering the connector 36 and the side beams 46 as they pivotally rotate relative to both the plow blade 14 and the frame 18. It will be noted here that in this embodiment, the selective raising or lowering of the plow blade 14 can be performed independently of the selective raising or lowering of the power broom 16.

The plow blade 14 can include a wearable cutting edge 50 connected to the blade 14A at the lowermost edge 34. The wearable cutting edge 50 is secured with fasteners 52 to the bottom 34 of the plow blade 14. The wearable cutting edge 50 can be replaced by removing and reinstalling the fasteners 52. In use, the wearable cutting edge 50 acts as a scraper blade to remove the snow and/or ice in close proximity to the ground surface. The wearable cutting edge 50 can be made from a material that will reduce the risk of damaging the ground surface as the wearable cutting edge 50 engages the ground surface. In use, the connector 36 can lower the plow blade 14 closer to the ground surface if the wearable cutting edge 50 has diminished in size due to wear. As known in the art, the wearable cutting edge 50 can be firmly secured to the remainder of the blade 14A or alternatively, be secured to the remainder of the blade 14A by a single or multi resilient shock absorbing device; and the wearable cutting edge 50 can be formed of a single section or of a plurality of sections extending along the width.

In the particular embodiment where the snow removal assembly 10 is provided as a front attachment as shown in FIGS. 1-4, the power broom 16 is disposed in front, i.e. ahead, of even a most forward wheel 76 of the vehicle. The power broom 16 rotates to sweep the snow (or other material being worked upon in the context of alternate embodiments) in a manner to urge it forward relative to the forward direction of travel 12. The power broom 16 is disposed immediately behind the plow blade 14 in the movement of travel of the vehicle, i.e. between the plow blade 14 and the most forward wheels 76 of the vehicle. In other words, the wheels 76 of the vehicle are behind the power broom 16 and do not extend between the power broom 16 and the plow blade 14. In some embodiments, the speed of rotation of the power broom can have a single predetermined setting. However, in other embodiments, it can be preferred for the speed of the power to be adjustable, either continuously, or to a number of discrete settings. Indeed, the faster the vehicle advances, the greater the incoming rate of snow, and it can be desired, accordingly, to increase the speed of rotation of the power broom.

Referring to FIG. 3, the broom 16 comprises bristles 54 extending from a central hub 56 surrounding a shaft 58 (shown in FIG. 2). The bristles 54 can be made from any suitable material, such as a polymer or metal, for example, as well known to persons having ordinary skill in the art. As such, the bristles 54 can bend as they engage the ground surface. In the embodiment shown, as the broom 16 rotates, the bristles 54 located at the lowermost part of the hub 56 have a tangential velocity 60 along the forward direction of travel 12 (it will be understood that only a portion of the tangential velocity 60 is along the forward direction of travel 12 when the broom 16 and plow blade 14 are operated at an angle 26). These bristles 54 sweep the snow in an initial path that is substantially parallel to the tangential velocity 60. The shaft 58 is rotatably mounted between two side connectors 62, which are integral to the frame 18. Accordingly, the bristles 54 extend between two side connectors 62. The side connectors 62 link the broom 16 to the frame 18. The shaft 58 is rotatably mounted between the side connectors 62 and, in this embodiment, the shaft 58 is positioned parallel to the length of the plow blade 14 (e.g. the corresponding longitudinal axes of the broom 16 and of the plow blade 14 are positioned substantially parallel to each other), and hydraulic motors are used at both opposite ends of the shaft to rotate the power broom.

In use, the bristles 54 may deteriorate and wear as they rotatably engage the ground surface. The wear can shorten the bristles 54 and cause the broom 16 to have a smaller diameter. Two different systems can be provided to address this. First, the power broom can be provided with a cover section which has a proximal end hinged to the frame 18 around a horizontal axis, and a distal end having a scraper blade designed to scrape the bristles and prevent snow from accumulating as known in the art. An extendible member 64 can be connected between the side connectors 62 and the cover section to allow adjusting the radial distance of the scraper blade, and thus bring the scraper blade in better engagement with the bristles once the bristles have become worn. Secondly, the shaft 58 of the broom 16 can be shifted closer toward the ground surface. Indeed, the supporting wheels 74 can raise and lower the frame 18 which allows the height adjustment of the shaft 58 at different elevations relative to the ground surface. An extendible member assembly 77 can be operated to adjust the elevation of the shaft 58 and/or to adjust a relative elevation between the plow blade 14 and the broom 16. The raising and lowering ability of the shaft 58 can be useful, for example, in a context where the bristles 54 have become worn, and have reduced in diameter, or when they are replaced by new bristles having a larger diameter than the formerly worn ones. In such a context, the shaft 58 can be lowered via the side connectors 62 to maintain a satisfactory engagement between the worn bristles 54 and the ground. The raising and lowering ability of the shaft 58 can also be useful if it is desired to operate the assembly with only the plow blade 14 engaging the ground (i.e. with the broom disengaged from the ground). As will be understood from the above, the assembly can also be operated with only the power broom 16 engaging the ground (i.e. with the plow blade 14 raised), with only the plow blade 14 engaging the ground, with both the power broom 16 and the plow blade 14 raised and disengaged from the ground, or with both the power broom 16 and the plow blade 14 lowered and engaged with the ground. The plow blade, and more specifically its extendible member assembly, can be provided with a sufficient pivoting span ability to allow to cover various scenarios, including operating the plow blade with the power broom 16 raised off the ground (in which case the lower edge of the plow blade is lower than the outer diameter of the unworn, maximum design diameter power broom), operating the plow blade with the power broom 16 fully worn, having its smallest design diameter, and operating simultaneously against the ground, and operating the fully worn power broom against the ground with the plow blade raised.

Accordingly, it can be useful in such an embodiment to provide the supporting wheels 74, or more specifically the connector member assembly 79, with a sensor adapted to measure the relative position of the supporting wheels 74 (and accordingly, the relative height of the frame 18). Indeed, the system can be provided with a computer having different heights stored in its memory, such as an operating height and a disengaged height for instance. The disengaged height can be pre-set and hardcoded, for instance, whereas the operating height can be adjustable. The system can have a user interface in the vehicle with a switch activatable to selectively move the frame 18 and the power broom 16 between the disengaged height and the operating height. The computer can control the movement of the frame 18 and power broom 16 based on the height values contained in its memory, and based on the feedback from the sensor, for instance. The user interface can further have a minute control feature such as a hardware or virtual (e.g. touch-screen implemented) rotatable button or sliding potentiometer, for instance, to allow adjusting the operating height during operation, to adapt to the wearing of the broom. The sensor can be provided in the form of a pivot sensor, for instance, which provides an indication of the height based on the degree of rotation of any suitable one of the parallel connector member assembly 79 pivot joints.

Figure 6:
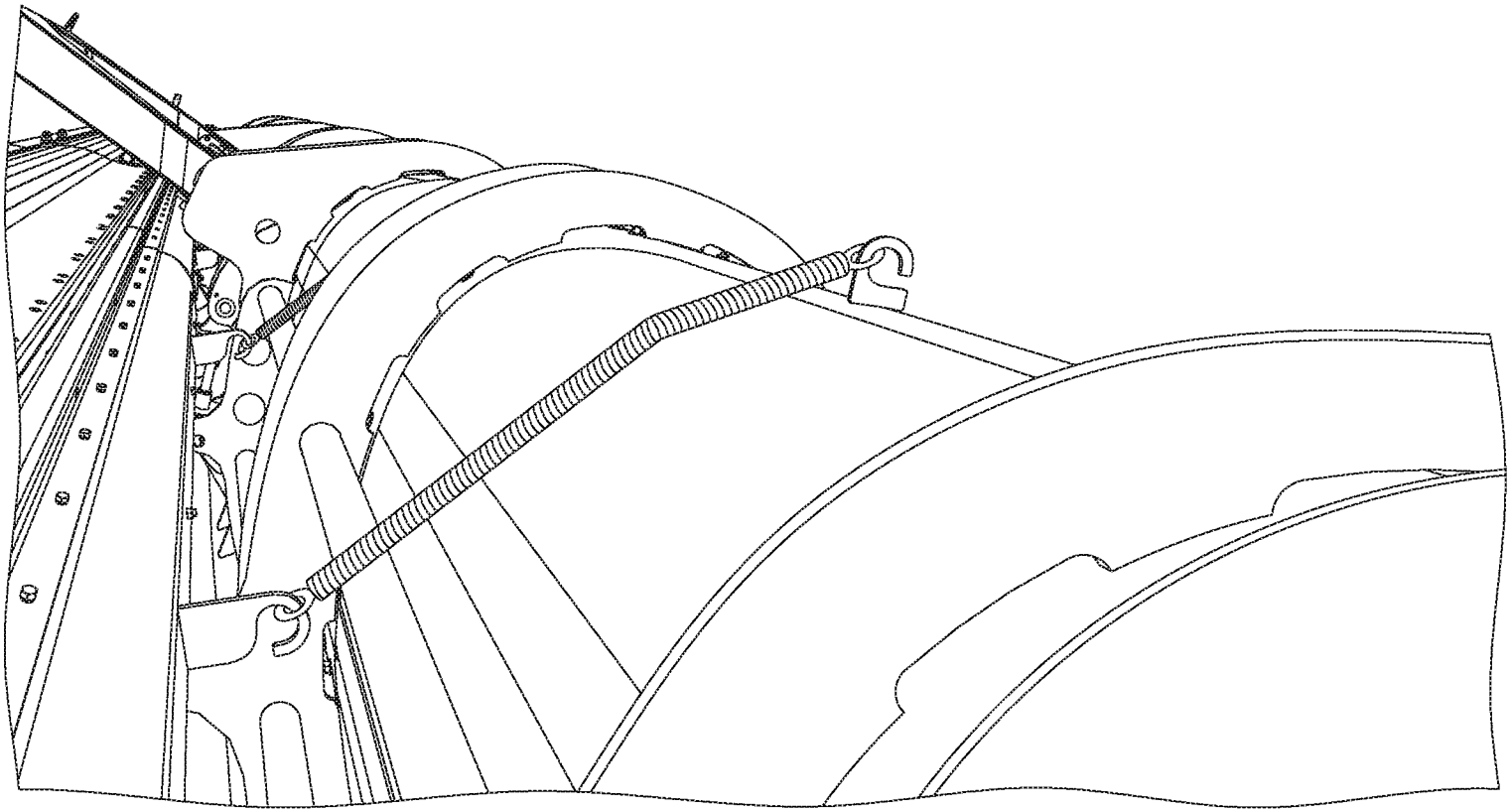
FIG. 6 is an oblique view taken from above and form the side, and showing the upper portion of the power broom and of the plow blade.
Figure 7:
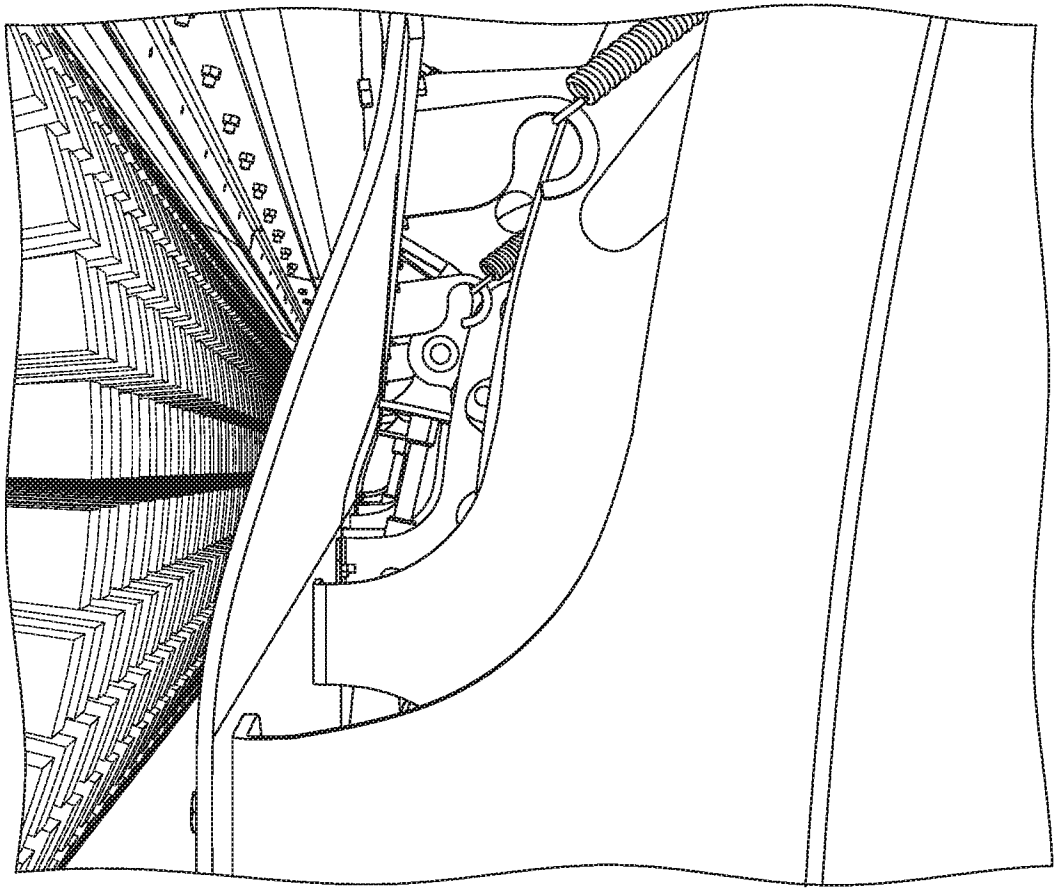
FIG. 7 is a side elevation view taken from the side and showing the shield member between the power broom and the plow blade.

Referring to FIG. 4, a shield 66 is shown between the back face 28 of the plow blade 14 and the power broom 16. Without the shield 66, in some snow conditions, snow pushed by the power broom can accumulate on the rigid rear surface 28 of the plow blade, build up, and eventually potentially form an accumulation of snow which could hinder the efficiency or otherwise be undesirable. The shield 66 being positioned in a manner to shield the back face 28 of the plow blade 14 from snow being brushed forwardly by the power broom. The shield can be made of a material which has a very low friction coefficient, facilitating the sliding of snow, and impeding snow buildup. Moreover, the shield 66 can be a layer of a material which offers a good compromise between flexibility and resistance. Indeed, the shield 66 can provide for the possibility of movement, to a certain extent, relative to the power broom, which may be beneficial to impede snow accumulation. The shield may thus be made of a flexible plastic sheet, for instance. In the embodiment shown, the shield 66 extends laterally between the side connectors 62 and vertically from a height corresponding to a height of the bottom of the power broom 16, and is fixed to an upper frame portion of the power broom 16, which is shown on the left hand side of FIG. 6. The shield can be held, at one or more intermediate height, to the plow blade, such as shown on the right hand side of FIG. 6 (upper intermediate height) and in FIG. 7 (middle intermediate height), which can be useful in holding most of the shield 66 in a suitable position between the power broom and the plow blade. In this embodiment, the upper intermediate-height connection is performed via elastic connections, such as hooks and springs for instance, to provide further flexibility and also allow raising of the shield when the plow blade is raised. The shield 66 that covers the bottom half of the broom 16 may adequately protect the back face 28 and collect the projected snow. In this embodiment, the shield 66 is even more extended vertically, and has a tip 70 which is curved rearwardly over the power broom 16 to collect the snow propelled vertically. The shield 66 can be secured to the plow blade 14 at an upper area thereof, in a manner to control the distance of the shield relative to the plow blade 14 and to the power broom 16.

The snow removal assembly 10 can include one or more supporting wheels 74 connected to the frame 18 to support a weight of the snow removal assembly 10 on the ground surface. In the particular embodiment shown, the wheels 74 are mounted between the mounting member 20 and the broom 16.

FIG. 4 illustrates in dashed lines the potential placements of the wheels 76 of the vehicle relative to the assembly 10. In a particular embodiment, the assembly 10 is mounted as a "front mount" ahead of the most forward wheel 76 of the vehicle. The assembly 10 is configured to be free from the wheels 76 of the vehicle between the plow blade 14 and the power broom 16. That is, no wheels 76 of the vehicle are located or mounted between the plow blade 14 and the power broom 16. As such, the plow blade 14 can scrape and remove the bulk of the snow from the ground surface and the immediately following power broom 16 can remove snow that may be left behind the plow blade 14.

Figure 8:
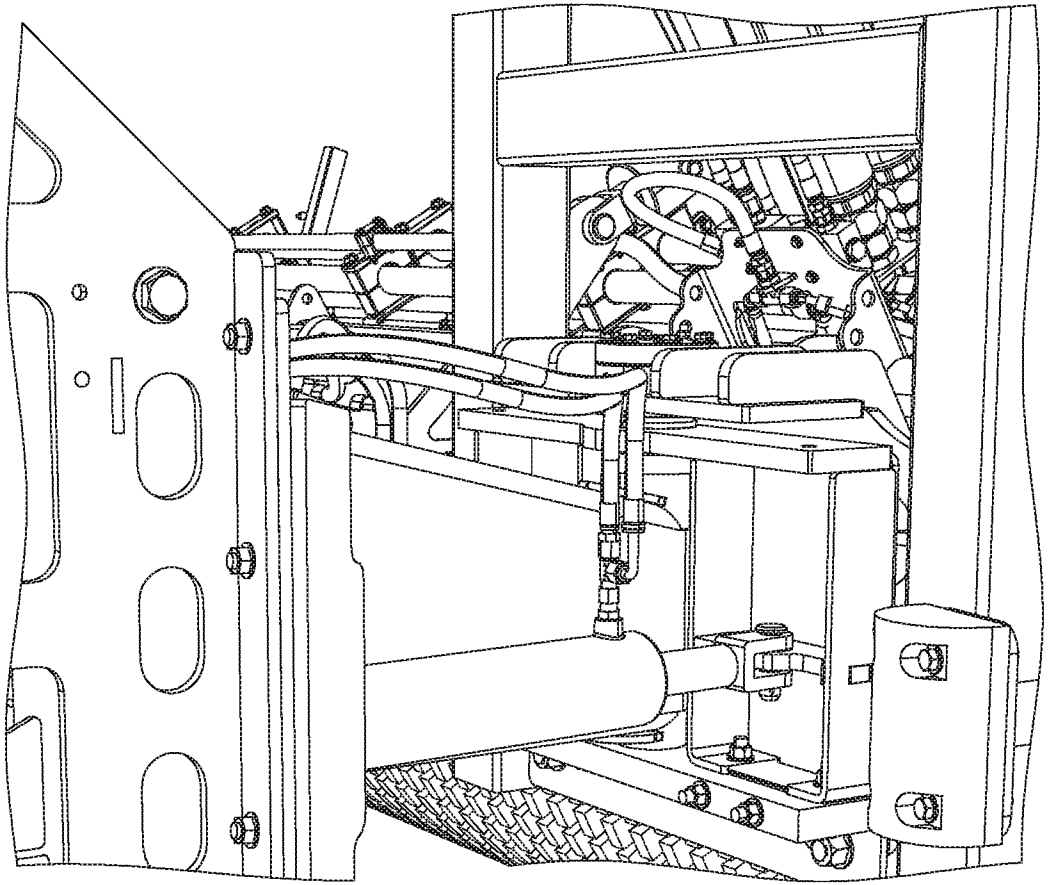
FIG. 8 is a view taken from the side and from the rear, and showing the connection between the vehicle and the snow removal assembly.
Figure 9:
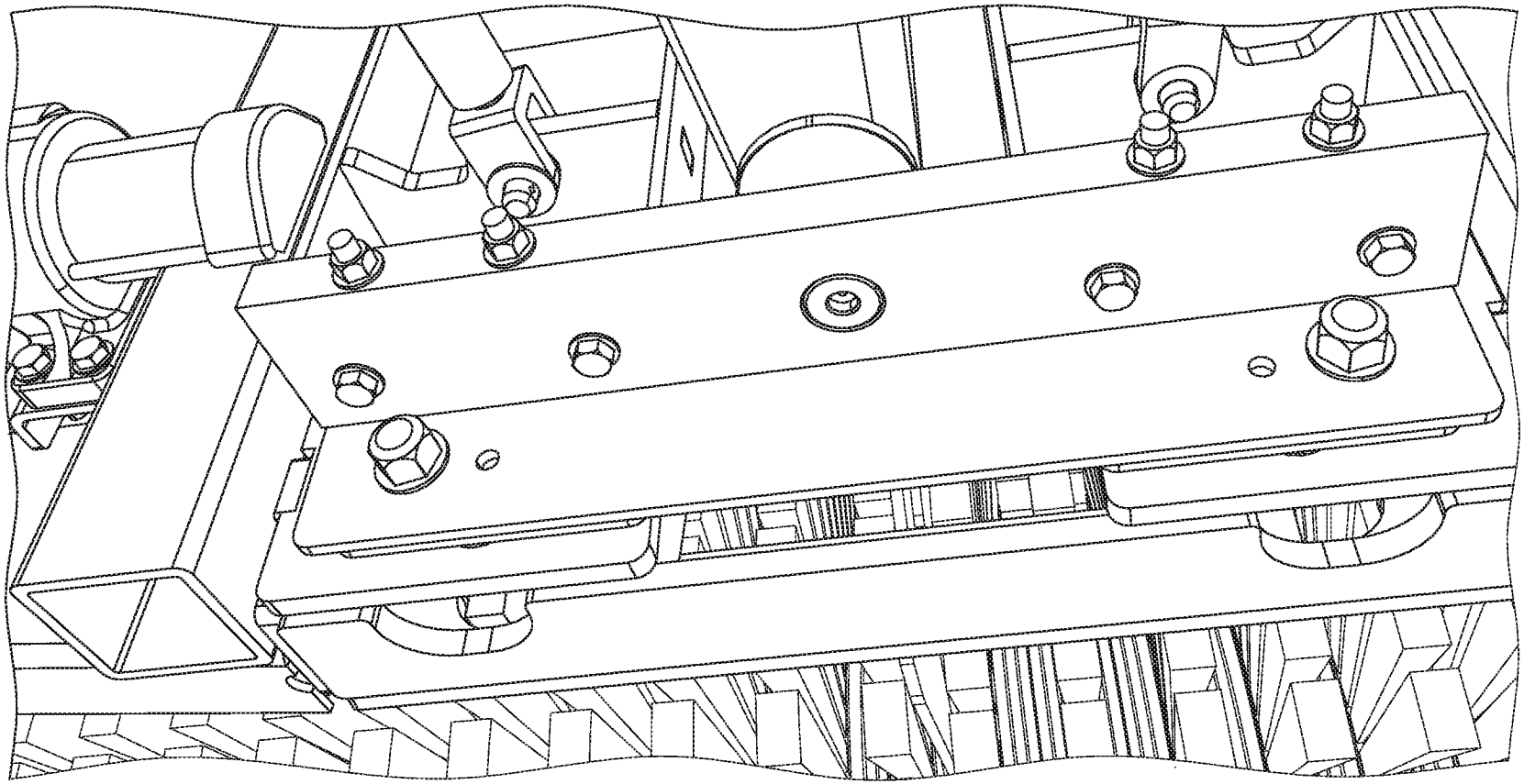
FIG. 9 is a view taken from the rear and from below, also showing the connection between the vehicle and the snow removal assembly.

In the embodiment illustrated, a mechanism is provided to allow a certain amount of roll, i.e. pivoting around a longitudinal axis, of the assembly relative to the vehicle blade. In other words, the plow blade and the power broom can collectively pivot around a central longitudinal axis, such as by raising the right side and lowering the left side, or vice versa, relative to the vehicle. This can be practical to allow to adapt to uneven terrain. In this embodiment, this pivoting ability is achieved by using a combination of ball joint and sliding plate assembly. Indeed, with reference to FIG. 8, a main mast member extends centrally along a longitudinal and horizontal axis between the vehicle extendible member assembly 90 and the frame. The vertical pivot axis is provided in the form of a vertically oriented shaft rotatably mounted in the distal end of the main mast member. The vertically oriented shaft is has a bearing socket at an upper end thereof, and the frame has a socket secured to a horizontal ledge thereof, which receives the bearing socket in a ball joint engagement. The frame has a first vertical wall which projects downwardly from a distal end of the horizontal ledge. A second vertical wall is made integral to the vertically oriented shaft. Extendible members are mounted on both opposite transversal sides of the mast member, between the second vertical wall and the vehicle mount. The extendible members can be activated to pivot the second vertical wall, and the shaft, around the vertical axis. The moving second vertical wall pushes the first vertical wall, which can also pivot around the vertical axis, which allows to thereby incline the blade in a horizontal plane (i.e. advancing the right side edge of the blade while retracting the left side edge of the blade, or vice versa), a movement referred to above. If the main mast member is raised, the force is transferred, via the ball joint, to the frame, and the assembly including the power broom and plow blade can be raised in this manner. The weight of the power broom and plow blade will result in a moment tending to pivot the first vertical wall around a transversal horizontal axis, via the ball joint, but this moment will be counteracted upon by the reaction force exerted by the second vertical wall, which cannot pivot in this manner as it is not integral to the casing of the ball joint, which will abuttingly receive the vertical wall. However, roll movement, i.e. pivoting between the first vertical wall and the second vertical wall, and thereby between the plow blade and power broom assembly and the vehicle, around a longitudinally oriented horizontal axis (direction of movement of the vehicle), remains allowed via the ball joint and would only result in the first vertical wall sliding against the second vertical wall. To this end, a layer of low friction material such as a resistant plastic can be used between the first vertical wall and the second vertical wall, to facilitate this sliding, and thereby facilitate the roll movement of the plow blade and power broom relative to the vehicle. In this embodiment, it was preferred to limit the possible span of the roll movement, and to this end, the second vertical wall was also provided with an upper horizontal ledge, with a spacing being provided between the upper horizontal ledge of the second vertical wall and the upper horizontal ledge of the first vertical wall. If the power broom and plow blade roll to a certain extent, which was determined to be 4° off horizontal in this specific example, the upper horizontal ledge of the second vertical wall comes into contact with, and acts as a stop to, the upper horizontal ledge of the first vertical wall.

EXAMPLE

A detailed example embodiment is now presented:

Broom and Plow Combined Front Attachment

The plow installed in front of the broom shall provide a clearing path of 19.6 ft while the broom head shall provide a swept path of 18 feet at maximum swung angle of 35 degrees. The broom shall be 46 inches in diameter and be capable of producing 4990 Ft-Lbs of torque and 525 RPM. The broom head shall be hydrostatic drive with infinitely variable speed hydraulic pumps and fixed displacement motors. The broom and the plow shall have the ability to remove snow, ice, slush, sand and other debris at rated speeds up to 40 MPH depending on conditions and this without creating wheel snow compaction.

Broom and Plow Angle

The broom head shall be capable of swinging 35 degrees maximum left or right, selectable from an operator's joystick. Using a longer broom than specified to accommodate swept path for larger swing angles is unacceptable due to storage and maneuverability reasons. The swing shall be accomplished by means of dual swing arms with four (4) pivot points, which ensures the weight of the broom head remains approximately on the chassis centerline regardless of the position of the broom head. The broom pattern shall not vary more than 0.5 inches end to end for the whole width of the broom.

The bearing mechanism shall allow frictionless motion through the swing and shall be accomplished by utilizing four vertical parallel shafts at least 2.5 inches in diameter at each end of both swing arms. The swing arms themselves shall be made from formed steel plate and machined steel tubing with grease-able low friction bushings, DX pre-lubricated type (no metal on metal).

BROOM AND PLOW OSCILLATION (Roll Movement)

The broom oscillation shall provide true flotation left to right for the broom head so that it is independent of broom chassis to accommodate surface irregularities and thus minimize brush pattern variation during operation. It shall have at least 8 degrees (+4, −4) of free floating oscillation from left to right. The ability of the broom head to oscillate shall be provided by means of a spherical bearing assembly and low friction nylon pads.

Broom Elevation and Brush Pattern Adjustment

The broom head lift shall be achieved utilizing two 5 inch diameter hydraulic lift cylinders, one on each end of the broom frame, controlled by the operator's joystick. The lift cylinders shall be equipped with a counterbalance valve, which prevents the broom head from creeping down. The pivoting action shall have adequate stroke to achieve ground clearance during transport when not in use.

An electrical weatherproof height sensor shall be embedded in the broom head lift wheel. This shall provide feedback to the controller system for closed loop assessment of the lift position. A joystick for remote broom lift control and pattern confirmation shall also be provided. This sensor provides broom height to the electronic control. The brush pattern adjustment process shall be accomplished inside the cab with an easy programmable target broom height to achieve the desire pattern. When programmed, the system automatically adjusts the broom height by mean of the electronic and hydraulic system to obtain a constant pattern. This target height can be readjusted and confirmed anytime by the operator. In addition to the manual system brush pattern adjustment, there shall be automatic broom pattern control with adjustment from cab. A time based system shall be used to readjust the broom pattern by counting the time in the broom down position. When the preset time is reached, the broom head will index down a preset amount. At that time the timer is reset and restarts counting. Time running in the up mode is not counted. Manually adjusting the pattern from the cab or broom head will reset the timer.

For safety reasons the operator cannot be positioned under or near the broom head or between the broom head and chassis to make the pattern adjustment.

Broom Head

The brush itself shall be 46 inches in diameter and 22 feet long comprised of two 11-foot sections. The broom head frame must sustain the loads imposed by the snow removal capacity of the unit. It shall be fabricated from 6.5 inch diameter steel tube in tube design with 0.38 inch walls and include provisions for grease between the mating surfaces. The hydrostatic broom drive shall be dual end drive. Power shall be supplied from two variable displacement hydrostatic pumps mounted on the engine's gearbox. The gearbox shall be a parallel shaft pump drive with precision gears and a dipstick for oil level measurement.

Two high-speed hydrostatic motors each connected to a planetary reduction gearbox shall be mounted within the inner diameter of the broom cores outer ends to minimize overall width. The motor gearbox connections shall utilize a static o-ring seal, wet spline type. No dynamic seal shall be used for reliability purposes. The motors shall not support the broom core loads and the planetary gear box shall be hydraulic oil bath lubricated (case flushing type). The entire broom head shall be vibration analyzed as a final inspection with report on vibration spectra (FFT plot). A sample of QA report with FFT plot can be provided on demand.

Speed of broom shall be infinitely variable from 225 to 525 RPM. Automatically adjusts the brush rotational speed proportionally to the vehicle speed between 10 km/h and 40 km/h. Manual override capabilities shall also be supplied. Available torque at the broom shaft shall be 4970 ft-lbs at hydraulic pressure of 6000 psi for maximum snow moving capabilities. Power shall be transmitted to the broom core from the gearboxes utilizing keyed tapered hubs to prevent any looseness in the connection for vibration concerns and high strength molded urethane drive cogs into replaceable hardened steel core drive sprockets of the core. Hardened steel pilot plates shall support the radial loads.

A maximum 2 inch gap between broom core sections shall be obtained by using a center dual idler with the same components as the drive ends. The idler bearings shall be encased in a sealed housing and be provided with oil bath lubrication.

The broom end plates shall be steel fabricated using 0.38 inch thick welded steel plate construction with 14 inch diameter, 0.38 inch thick steel tube for mounting the broom drive gearboxes. The end plates shall be reinforced horizontally and vertically using, 2"×6" structural rectangular tubing on the inside and 3"×6.5" formed channel on the outside. The broom end plates shall be secured to broom frame with four 1 inch diameter grade 8 bolts.

The unbolted end plates shall slide outward to allow easy access for core and bristle replacement. The slide mechanism shall be 4.5 inch round telescoping tube in tube design. A second 2 inch square tube shall slide on a plastic slide providing additional support and allowing repeatable location of brush centerline alignment during broom core remove and replace operations.

Plow Construction

The front plow width shall be 20 feet and the height shall be 52 inches. The uniform height moldboard shall be made from Polyethylene and has no flared ends. The moldboard sheets provide a low coefficient of friction and resistance to corrosion and impact. The moldboard sheets shall be made from ⅜ inches thick high molecular weight polyethylene sheets in conformance with ASTM D 638-03.

The front plow frame shall be expressly designed to resist continuous heavy snow removal operation at high speed for airport runway & ramp plowing. The plow cutting edge sub-frame shall be structurally reinforced to add strength to the cutting edge. Cutting edge type shall be proposed as indicated: tungsten carbide, rubber, polyurethane, high carbon steel, Rubber section with carbide inserts, Reverse angle style cutting edges (cupped type).

The moldboard attack angle shall be adjustable between 65° to 85° to enhance performance to the plowing operation. The plow shall be equipped with an automatic cushioning system that minimizes the damage to the moldboard, cutting edge, carrier vehicle and to enhance driver safety. The plow shall be equipped with four caster wheel with anti-wobbling technologies capable of 360° rotation. A vertical infinite adjustment shall be made by an adjustment screw for each caster wheel. A spray guard shall be fixed on top of the moldboard flange to direct the snow to the proper discharge area and minimize snow build-up on the frame. Reversing of the plow shall be achieved by hydraulic cylinders. A relief valve shall be plumbed to minimize damage in the event of contact with an immovable obstruction. Hydraulic functions shall be accomplished through the use of a hydraulic control valve. All hydraulic lines shall be attached to the vehicle with quick connect coupler for an easiest decoupled operation. The plow shall be designed to stand upright and steady when decoupled. This position allows easier and ready re-hitching operation.

Broom Cores

The two core sections must be split core design for easy handling and efficient (tight) wafer stacking and sustain the loads imposed by the snow removal capacity of the unit. They shall be tubular steel construction with four drive bats, equally spaced around a tube to center each brush wafer. The drive sprockets shall be replaceable. Each core shall be individually dynamically balanced to acceptable values at rated RPM.

The brush on the cores shall be full width and designed for runway operation and shall be field replaceable with maximum ease without the use of special tools. The wafers shall be a 50/50 combination of polypropylene and wire, confirming to Mil Spec F-83002. The bristles shall be fastened in a radial wafer fashion to a steel ring. Polypropylene bristles shall be fastened to the steel ring by fusing their base to form a solid loop about the circumference of the ring, then mechanically holding them in place by wrapping the top of the ring over the fused bristle ends to form a dovetail. Wre bristles shall be fastened to the steel ring with wire. The polypropylene bristles shall be 0.075"×0.105" oval shaped with an 8 pounds total wafer weight minimum. The wire bristles shall have a mean diameter of 0.018 inches, galvanized, with a carbon content of 0.81 to 0.86 percent and a 10 pounds total wafer weight minimum. All wafers shall be a within 50 oz-in static balance and marked at the heavy location.

Broom Bristle Replacement

The bristle replacement sections shall be 33 inches in length and all sections shall be of the same length. They shall be made of a molded reinforced plastic designed to eliminate and guarantee against distortion of the cassette section.

There shall be a polyurethane formed (molded) cup, which extends up the length of the tuft no less than three inches for support. This formed cup shall have vertical risers of the same material to hold the upper rings of polyurethane in place and strengthen the cup. The cups shall be molded in a way that every four cups are interconnected from the base to the top of each cup by the same polyurethane material that the cups are made of.

The distance between the center of each cup shall be a maximum of 41.5 mm. Each tuft shall consist of 120 pieces of zinc coated steel wires with a quality grade of "C". The wires shall be electro-galvanized, hard drawn crimped steel and exhibit a high fracture resistance, bent in a "U" shape and held in place "in the cup" by a ⅛ inch diameter steel rod that runs the full length of each cassette section. Each cassette section shall contain 20 tufts of 0.045 mm wires as described above.

The bristles shall be suitable for use in temperatures seen at the altitude of the airport and be guaranteed for a period of one year and one full use of the bristles down to the maximum wear The length of each tuft shall be 11 inches from the top of the cassette strip to the tip of the wire bristles.

The cassettes shall be designed to eliminate any possibility of the bent wire tufts from distorting the cassettes during storage that could be up to two years. The supplier shall guarantee that this distortion will not occur.

Each set shall consist of the proper amount of cassette sections to fill the entire core. The reinforcement between the cups adds rigidity to all four of the cups/tufts which will reduce the bending movement while sweeping and give a better flicking action. The distance between the tufts is important for better sweeping action at full angle and most important when the broom head is at less than full angle.

Broom and Plow Casters

There shall be four single tire caster assemblies for the 22-foot broom and plow. Since a weight transfer hitch shall be utilized, the chassis carries approximately 65% of the broom and plow weight. The broom casters shall carry the remaining weight of the broom head. With the reduction in weight and tires, fewer tires shall be required and tire maintenance reduced. Each caster assembly shall be free to rotate 360 degrees. The radial pneumatic tires shall be 180/70R8 16 ply. Pre-loaded friction device shall be supplied per caster to prevent caster shimmy at all sweeping speeds. The caster assembly shall be non suspension type allowing the brush to follow the ground contours as close as possible. The broom head caster support shall be mounted to the main broom frame by means of welded brackets constructed of 0.5 inch steel plate, minimum. The steel caster assembly shall be attached to the broom head caster support by means of four bolts for serviceability. The caster axle shall be supported by the caster mounting body constructed of 0.63 inch plate.

Hydraulic System

All hoses for all systems shall be properly sized and strength to work with the pressure and volume of oil required. All hydraulic positioning functions (broom head lift, broom head swing and deflector) shall be equipped with a hydraulic position locking system. A counterbalance valve shall be used for the broom lift. Plow lift shall be possible independently of the broom lifting system and have the floating capability. All hydraulic functions shall be electric over hydraulic valving. Connectors to the solenoids shall be interlocking type to provide a secure connection, which can withstand normal pressure washing procedures. Piloted operated check valves shall be installed for the broom swing left and right and deflector up and down. Fluid and components shall be design for temperature to −20 degrees F. ambient cold start. The hydraulic fluid reservoir shall be cyclonic type with lowest volume possible for the design. Shut off valves for all filters below tank fluid level shall be installed to allow filter changes without loss of oil.

Proper filtering shall be done on both the high pressure and low pressure circuits and shall conform to SAE J931. There shall be a 5-micron absolute rating on the hydrostatic pumps' filters and placed in the charge pressure lines. One spare spin on canister provided for each of these charge pressure filters. There shall be a clogged filter indicator light on the cab control panel indicating filter replacement.

The hydraulic oil cooler shall be integral to the radiator and charge air cooler package. It shall be controlled by a thermostatic switch to avoid excessively cold oil operation and designed such that thermostatic failure results in the cooling fan being engaged. A pressure relief shall allow cold hydraulic oil to bypass the cooler for shorter warm up times. A warning light for low hydrostatic oil level shall also be supplied.

Controls and Instrumentation

Functional control of vehicle shall be centered on an electronic control system utilizing J1939 data bus. Reliability and precision operation of the unit requires heavy reliance on solid state circuitry and components and minimized reliance on traditional multi-pin "physical switch" type relays. Electronic control systems shall include on board diagnostic assistance and other features to simplify the operation, troubleshooting, and repair of the unit.

All controls shall be electric over hydraulic type. All instruments and controls shall be labeled in a manner to remain legible for the life of the unit and shall be illuminated. All wiring shall be either harness, cable, split loomed, or shrink-wrapped. All wiring shall be color-coded, wire numbered matching drawing schematics and terminal strip, and labeled. The gauge wire and processes shall be in accordance with common wiring practices, GXL insulation type.

The operator's broom control system in the chassis cab shall have an Active Matrix Display station. It shall use a 7 inch minimum color liquid crystal display screen and use CAN (Controller Area Network) serial bus system technology. The AMD must incorporate diagnostics. All systems for the broom and broom engine must be part of the diagnostics. All functions and displays must be in easy reach of the operator and contiguous with the chassis instrumentation.

The control in the chassis cab shall have all the necessary functions to operate the broom and air blower and shall have the following:

A. System on/off (keyed)

B. Multifunction CAN controlled joystick for broom head lift/lower and left/right swing. It shall also incorporate the deflector angle.

The broom swing, lift and blower nozzle shall be microprocessor controlled (no relays) and have automatic function for cycle complete control. This allows the operator to have hands free operation during cycle movement. Moving the joystick in the opposite direction can top and reverse the cycle. A switch shall allow the operator to use the automatic control or disengage the system.

C. Command and Display:

1. Mechanical sealed pushbuttons
2. Broom engine main operating screen a) Engine, broom and air blower speed control and display b) Oil pressure with visual and audible warning alarms c) Coolant temperature with visual and audible warning alarms d) Hydraulic oil temperature with visual and audible warning alarms e) Engine tachometer f) Voltmeter and warning indicators g) Air filter restriction warning and alarm h) Alarms for engine diagnostics and visual warning indicators and displayed faults i) Mode selector: auto/manual j) Status display for:

1) Broom/air duct coordination

2) Weight transfer system

3. Menu selection screen: specific AMD function screens are accessed through this screen
4. Video screen a) Enables the video system to be manually turned on and off b) To be used for future installation of video camera system (when applicable)

5. Lighting screen
a) Daytime/nighttime display screen brightness selection
6. Joystick/touch pad screen: this screen mimics the features of the joystick and touch pad
a) Joystick lift up/down
b) Joystick swing left/right c) Deflector up/down
d) Mode auto/manual e) Broom on/off
f) Plow on/off
g) Plow up/down
h) Vibrator on
7. Engine hydraulics screen: this screen is used for systems monitoring
a) Engine, broom and display
b) Percent engine power
c) Engine hour meter
d) Inlet air temperature
8. Settings screen
a) Joystick control: broom only, plow only, or both
b) Joystick control: plow only
c) Weight transfer with audible alarm when in the off position
d) Core life hours
e) Maintenance hours
f) Automatic broom pattern control
1) Pattern increase/decrease
2) Broom height position
9. Engine diagnostics screen
a) Display active faults
b) Active fault codes
10. Output diagnostics: this screen is for display only and shows the controller output diagnostics.
a) Individual system output test function
b) Output diagnostics last 100 fault history
11. Setup screen: this screen allows authorized personnel to change the vital settings without the use of a notebook computer and is password protected.
D. Separate back light touch pad for:
1. Deflector up/down
2. Mode auto/manual
3. Broom on/off
4. Air Blower on/off
5. Plow
6. Vibrator with minimum 3,200 pounds of force.

The above description is meant to be exemplary only, and one skilled in the art will recognize that changes may be made to the embodiments described without departing from the scope of the invention disclosed. For example, in a particular embodiment, a snow blower and/or an air blower can replace the power broom. Of course, although the preferred embodiment is adapted to address snow, the assembly can be adapted to work on other types of particle materials as well, such as sand for instance. Still other modifications which fall within the scope of the present invention will be apparent to those skilled in the art, in light of a review of this disclosure, and such modifications are intended to fall within the appended claims.

The invention claimed is:

1. An assembly for releasable attachment to a motorized vehicle, the assembly comprising:
a frame;
a mounting member extending rearwardly relative to the frame and configured for attachment to the vehicle;
a plow blade mounted at a front of the frame via a pivotal dual arm assembly maintaining an angle of attack between the plow blade and a ground independently of a relative height of the plow blade relative to the frame, the dual arm assembly having an upper connector member and a lower connector member both having a fixed length, each of the upper connector member and lower connector member pivotally mounted at fixed positions relative to the plow blade and the frame, the upper connector member and the lower connector member vertically interspaced from each other; and
a power broom secured to the frame between the mounting member and the plow blade, the power broom configured to be disposed in front of a most forward wheel of the vehicle relative to a forward direction of travel of the vehicle, the power broom configured to rotate and sweep towards the front:
wherein the pivotal dual arm assembly has an actuator activatable to selectively raise or lower the plow blade relative to the height of the frame:
wherein the actuator is operable in a floating mode; and
wherein the floating mode is a non-compensated floating mode wherein no raising force is exerted on the plow blade and the full weight of the plow blade is supported by the around.

2. The assembly as defined in claim 1, comprising a shield extending vertically between the plow blade and the power broom.

3. The assembly as defined in claim 2, wherein a tip of the shield is curved toward the power broom and is extended rearwardly at least partially over the power broom.

4. The assembly as defined in any one of claim 3, wherein the shield is fixed to an upper frame portion of the power broom and held at an intermediate height of the plow blade.

5. The assembly as defined in any one of claim 3, wherein the shield is flexible.

6. The assembly as defined in any one of claim 5, wherein the shield is made of a plastic sheet.

7. The assembly as defined in claim 2, wherein the power broom is configured to rotate to sweep snow forward relative to the forward direction of travel.

8. The assembly as defined in claim 1 wherein the frame has a wheel assembly configured to support its weight on the ground.

9. The assembly as defined in claim 8 wherein the wheel assembly is connected to the frame via a dual arm assembly having an actuator activatable to selectively raise or lower the frame relative to the ground.

10. The assembly as defined in claim 1, wherein a powered vertical pivot connection is provided between the frame and the mounting member, allowing to selectively pivot the power broom and the plow blade obliquely with respect to the direction of travel of the vehicle.

11. The assembly as defined in claim 1, wherein the plow blade and the power broom are each raisable out from engagement from the ground and lowerable into engagement with the ground, independently from each other.

12. A snow removal vehicle comprising:
a chassis having vehicle wheels and being movable in a forward direction of travel;
a frame;
an adjustable-height mount connecting the frame to the chassis and allowing to selectively raise or lower the frame relative to the chassis;
a plow blade also mounted to the chassis in front of the vehicle wheels relative to the forward direction of travel via a pivotal dual arm assembly maintaining an angle of attack between the plow blade and a ground independently of a relative height of the plow blade relative to the chassis, the dual arm assembly having an upper connector member and a lower connector member both having a fixed length, each of the upper connector member and lower connector member pivotally mounted at fixed positions relative to the plow blade and the frame, the upper connector member and the lower connector member vertically interspaced from each other; and a power broom mounted to the frame between the plow blade and the vehicle wheels in a manner to be raised and lowered upon said selective raising and lowering of the frame:

wherein the plow blade is mounted to the chassis via the frame.

13. The snow removal vehicle as defined in claim 12, comprising a shield extending vertically between the plow blade and the power broom.

14. The snow removal vehicle as defined in claim 12, wherein the pivotal dual arm assembly has an actuator activatable to selectively raise or lower the plow blade relative to the height of the frame.

15. The snow removal vehicle as defined in claim 14 wherein the actuator is operable in a floating mode.

16. The snow removal vehicle as defined in claim 12 wherein the frame has a wheel assembly configured to support its weight on the ground.

17. The snow removal vehicle as defined in claim 16 wherein the wheel assembly is connected to the frame via a dual arm assembly having an actuator activatable to selectively raise or lower the frame relative to the ground.

18. The snow removal vehicle as defined in claim 12, wherein a powered vertical pivot connection is provided between the frame and the adjustable-height mount, allowing to selectively pivot the power broom and the plow blade obliquely with respect to the forward direction of travel of the vehicle.

19. The snow removal vehicle as defined in claim 12, wherein the plow blade and the power broom are each raisable out from engagement from the ground and lowerable into engagement with the ground, independently from one another.

20. An assembly for releasable attachment to a motorized vehicle, the assembly comprising:

a frame:

a mounting member extending rearwardly relative to the frame and configured for attachment to the vehicle:

a plow blade mounted at a front of the frame via a pivotal dual arm assembly maintaining an angle of attack between the plow blade and a ground independently of a relative height of the plow blade relative to the frame, the dual arm assembly having an upper connector member and a lower connector member both having a fixed length, each of the upper connector member and lower connector member pivotally mounted at fixed positions relative to the plow blade and the frame, the upper connector member and the lower connector member vertically interspaced from each other: and a power broom secured to the frame between the mounting member and the plow blade, the power broom configured to be disposed in front of a most forward wheel of the vehicle relative to a forward direction of travel of the vehicle, the power broom configured to rotate and sweep towards the front:

wherein the pivotal dual arm assembly has an actuator activatable to selectively raise or lower the plow blade relative to the height of the frame:

wherein the actuator is operable in a floating mode; and wherein the floating mode is a compensated floating mode wherein a compensating raising force no greater than the weight of the plow blade is exerted on the plow blade.

* * * * *